United States Patent [19]

MacKay, Jr. et al.

[11] 4,149,294

[45] Apr. 17, 1979

[54] POLISHING BUFF

[76] Inventors: Joseph H. MacKay, Jr., 31 Pepper Ridge, Stamford, Conn. 06905; Jack M. Haigh, 14 Overlook, Rye, N.Y. 10580

[21] Appl. No.: 758,621

[22] Filed: Jan. 12, 1977

[51] Int. Cl.[2] ..... B24D 13/14

[52] U.S. Cl. ..... 15/230.12; 15/230.18; 428/95

[58] Field of Search ..... 15/230, 230.12, 230.18, 15/230.19; 51/376–379, 401, 407; 156/224; 428/95

[56] References Cited

U.S. PATENT DOCUMENTS

| | | | |
|---|---|---|---|
| 871,965 | 11/1907 | Stewart | 15/230.18 |
| 1,640,032 | 8/1927 | Fiechter | 15/230.18 |
| 1,859,922 | 5/1932 | Holland | 428/95 X |
| 2,838,891 | 6/1958 | Haywood | 51/407 |
| 2,910,762 | 11/1959 | Priester | 428/95 |
| 2,950,584 | 8/1960 | Welch | 51/378 |
| 2,996,851 | 8/1961 | Gianatasio | 51/378 |
| 3,007,189 | 11/1961 | Crane | 15/230 |
| 3,100,905 | 8/1963 | Salick | 15/230.19 X |
| 3,430,283 | 3/1969 | Engel et al. | 15/230.12 |
| 3,561,938 | 2/1971 | Block et al. | 51/358 |
| 3,747,286 | 7/1973 | Haigh | 51/379 X |

FOREIGN PATENT DOCUMENTS

| | | | |
|---|---|---|---|
| 427252 | 4/1935 | United Kingdom | 51/407 |

*Primary Examiner*—Daniel Blum

*Attorney, Agent, or Firm*—Nilsson, Robbins, Dalgarn, Berliner, Carson & Wurst

[57] ABSTRACT

A buffing pad wherein a layer of fabric has tufting material stitched therein and extending outwardly from one side thereof. A layer of adhesive which is flexible after it has set is applied to the surface of the fabric opposite that from which the tufting material extends. A metallic washer having a centrally formed screw thread therein is sandwiched between the adhesive material and a backing layer. The backing layer has an outer edge which is displaced inwardly from the outer edge of the fabric layer by a substantial amount. The outer peripheral portion of the fabric layer along with the adhesive material which extends to the outer edge thereof is curved upwardly and the curved portion is maintained solely by the adhesive material. The curved portion is formed by utilizing a mold form having the desired configuration which is brought into contact with the adhesive prior to its setting and by applying appropriate pressure to the mold form and the coated fabric and maintaining the pressure until the adhesive has set.

4 Claims, 4 Drawing Figures

POLISHING BUFF

BACKGROUND OF THE INVENTION

This invention relates generally to polishing buffs and more specifically to polishing buffs having curved peripheral edges, which buffs are intended to be secured to the rapidly rotating head of a polishing apparatus for polishing surfaces of various shapes such as newly painted metallic surfaces of automobiles and the like.

Polishing buffs of the type above referred to are frequently made in the form of lambs wool backed with or stitched on a sheet of relatively hard canvas for strength and dimensional stability. The lambs wool is then cut to form a wool pile extending from the canvas sheet. The prior art buff is usually provided with a central aperture for attachment to the rotatable head of a manually controlled power apparatus. Such prior art buffs after a relatively short period of usage would have insufficient cushioning action particularly at the outer periphery thereof and thus permit the the buff to cut, abrade or burn paint on the surface being buffed, thereby necessitating repainting of the damaged area. Curved peripheral edges have been applied to such buffs to overcome the previous prior art problems experienced with such polishing buffs.

The upwardly curved outer periphery of such polishing buffs has in the prior art been formed through the utilization of a layer of material affixed to the flexible fabric sheet which carries the wool pile tufts. The additional sheet or layer of material has been formed of fabric or plastic which is secured to the tuft-carrying fabric sheet. The curvature at the peripheral edge of the buff has been provided by the adhesive securing the extra layer of material to the fabric or by the plastic material.

In either event the curved outer peripheral edge of the polishing buff has a degree of stiffness which is determined by the stiffness of the material forming the curve and the material backing up the fabric layer to which the tufts are secured. As a result, when applications require the edge of the pad to be inserted into relatively sharp radiuses or corners, the stiffness of the curved outer peripheral edge of the buff results in damage to the paint. In many instances the curved edges of the prior buffs have been sufficiently stiff to preclude their use in very sharp corners or sharp radiused places.

The best prior art known to applicant which relates to this invention is manifested in U.S. Pat. Nos. 2,329,222, 2,838,891, 3,007,189, 3,007,289, 3,086,821 and 3,342,533.

SUMMARY OF THE INVENTION

A polishing buff including a fabric layer with tufted material extending outwardly from one side thereof with an adhesive layer covering the entire other side of the fabric. The adhesive which is utilized has a characteristic of being flexible when it has been allowed to set. The entire continuous peripheral portion of the fabric layer with the adhesive thereon is permanently curved with the adhesive layer constituting the sole means for maintaining the curved configuration.

In accordance with the method of the present invention, there is provided a fabric layer with tufted material extending outwardly from one surface thereof. A layer of adhesive having the characteristic of being flexible when set is applied to cover the other side of the fabric layer. A mold form having the desired surface configuration to provide a curved peripheral portion is placed upon the adhesive layer after which pressure is applied to the resulting combination and is maintained until the adhesive has set. The mold form is then removed.

DETAILED DESCRIPTION OF THE PREFERRED EMBODIMENT

Figure 1:
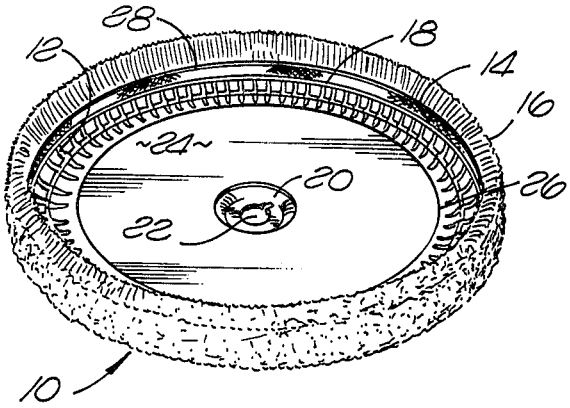
FIG. 1 is a perspective view illustrating a polishing buff constructed in accordance with the principles of the present invention.

A buffing pad 10 constructed in accordance with the principles of the present invention includes an outer curved peripheral portion 12 which is formed in such a manner as to be extremely flexible and soft. As a result of such construction, a user of such a buffing pad having an upwardly curved outer portion is not limited as to the applications thereof as is the case with the prior art curved edge polishing buffs. The extremely flexible outer peripheral portion 12 of the buffing pad 10 may bend or curve to fit or follow tight contours, while at the same time being extremely soft as a result of the flexibility of the material forming the curved edge to thereby eliminate the possibility of burning, abrading or otherwise damaging the paint upon the surface being buffed.

This feature of extreme flexibility and softness in the peripheral portion 12 of the buffing pad 10 is accomplished by utilizing an adhesive which is flexible after it sets to form and maintain the upward curvature of the peripheral portion 12. No other backing material such as fabric, plastic, or the like, is utilized as has been the case with respect to the prior art devices. It had previously been thought that the desired curvature in the peripheral portion of such a buffing pad could only be formed and more particularly maintained after its formation, through the utilization of some type of additional backing material. Such, for example, as the fabric taught in U.S. Pat. No. 3,007,289, or the plastic as taught in U.S. Pat. No. 3,342,533.

Applicant's buffing pad is constructed by providing a fabric material 14 preferably of duck, drill cloth or the like, which is then tufted by stitching lambs wool or other fibers into the fabric 14 thereby to provide tufting 16 which extends from one surface only of the fabric layer 14. A layer of adhesive 18 completely covers the other surface of the fabric layer 14 and after setting, as will be described more fully hereinafter, provides and maintains the curved peripheral portion 12. In addition thereto, the adhesive secures in place a metallic washer 20 having a central aperture 22 forming a screw thread as well as backing layer 24 secured to the fabric layer 14. The metallic washer 20 is sandwiched between the backing layer 24 and the fabric layer 14. It will be noted that the backing layer 24 has an outer peripheral edge 26 which is disposed inwardly from the outer edge 28 of the fabric layer 14 in such a manner that the backing layer 24 does not extend onto the curved peripheral portion 12 of the buffing pad 10.

As will be recognized by those skilled in the art the screw thread 22 provided in the metallic washer 20 is used to secure the buffing pad 10 to a threaded stud which is affixed to the spindle of a power driven buffing apparatus which may or may not include a support pad thereon. Since such structure is well known to those skilled in the art, no further description thereof is deemed to be required herein.

Figure 2:
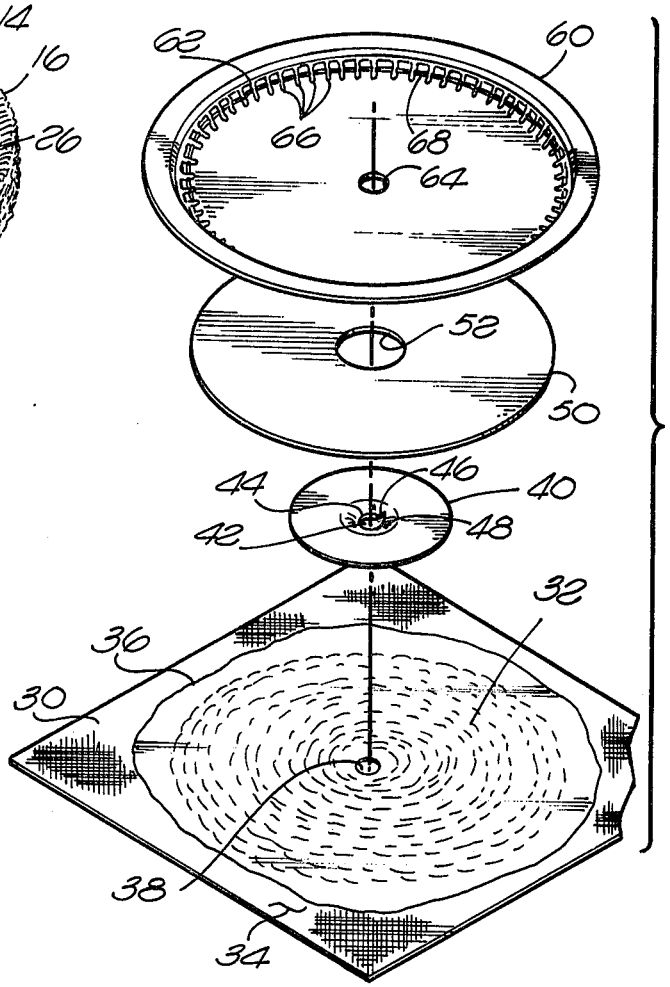
FIG. 2 is an exploded view showing various parts of polishing buff as illustrated in FIG. 1 but in an early stage of construction.

Referring now more particularly to FIG. 2, there is disclosed component parts which are utilized to make up the buffing pad as illustrated in FIG. 1 and in additional thereto a mold form used in the manufacturing of the disc 10. As is shown in FIG. 2 the fabric layer may be a square sheet 30 of fabric material cut from a larger roll. The tufting material is stitched in a spiral fashion as indicated at 32 into the fabric 30. The tufting is accomplished by tufting methods and apparatus that are known in the prior art and comprise generally a sewing machine adapted to stitch the tufting material through the fabric and to sever outwardly projecting loops of fibers to thus form a pile projecting from one surface of the fabric 30 (in FIG. 2 the surface not shown) while retaining on the opposite side 34 of the fabric 30 the non-severed tufting material such as lambs wool. As a result of the well known prior art tufting methods and apparatus, it is not deemed required to provide additional description thereof herein.

Subsequent to the tufting of the fabric 30 a layer 36 of adhesive is applied to the surface 34 of the fabric 30 in such a manner as to completely cover the tufting material 32. As known in the prior art, the adhesive 36 is utilized in conjunction with the fabric 30 and the tufting 32 to hold the tufting 32 in place upon the fabric 30 and to prevent the same from being drawn therethrough. This type of utilization for the adhesive material 36 is described in U.S. Pat. No. 2,329,222 and has been the traditional utilization for such adhesives. The adhesive utilized is one which is flexible after it sets up and preferably is a latex adhesive. Specifically, applicant has discovered that a resin-latex adhesive is best for the specific purposes intended herein to form the curved outer peripheral portion 12 of the buff 10.

Subsequent to the application of the layer 36 of adhesive a washer-like metallic member 40 having a central aperture 42 defined therein is centrally located upon the fabric 30 so that the aperture 42 is aligned with an aperture 38 provided centrally in the fabric 30. The aperture 42 is formed by a lip 44 which is broken at 46 and formed so as to define a screw thread. The washer-like member 40 may be formed, for example, from cold rolled steel and then shaped into the configuration illustrated, as by stamping or the like to provide the slight depression as illustrated in FIG. 2 at 48 therein to thereby permit the entire disc to be readily locked in place upon the power buffing tool.

Subsequent to placing the washer 40 in position upon the fabric 30 a backing layer 50 having a central aperture 52 therein is also placed over the washer 40 and upon the layer 36 of adhesive with the apertures 52, 42 and 38 aligned. The backing layer 50 may be of any material which is desired to impart integrity to the flat portion of the buff 10, that is, that portion disposed inwardly from the curved peripheral portion 12. Preferably, the backing layer 50 is formed of a plastic material such as vinyl, polycarbonate, polyurethanes or the like.

After the assembly of the fabric layer 30, the metallic washer-like member 40 and the backing layer 50, a mold form 60 is placed upon the surface 34 of the fabric 30. The mold form is constructed with a surface portion 62 that conforms to the desired configuration for the curved portion 12 of the buffing pad 10. As is illustrated, the mold form 60 also defines a centrally disposed aperture 64 which is aligned with the apertures in the remaining portions of the assembly. As is shown, the area 62 on the mold form 60 includes a plurality of ridges 66 with adjacent ridges being interconnected by a transversely disposed ridge or groove 68. The combination of the ridges 66 and 68 provide a corrugated effect to the surface area 62 of the mold 60 which, as will be hereinafter described, is imparted to the curved portion 12 of the buff 10. The mold form 60 may be constructed of any material desired which will release from the layer 36 of adhesive. It has been found that the mold form 60 is preferably constructed of thermoformed polyethylene. It will, however, be understood that the mold form 60 could be constructed of vinyl plastic coated with an appropriate release agent or alternatively, other plastic or other materials which appropriate release agents applied thereto to preclude the layer 36 of adhesive from permanently adhering to the mold form 60.

Figure 3:
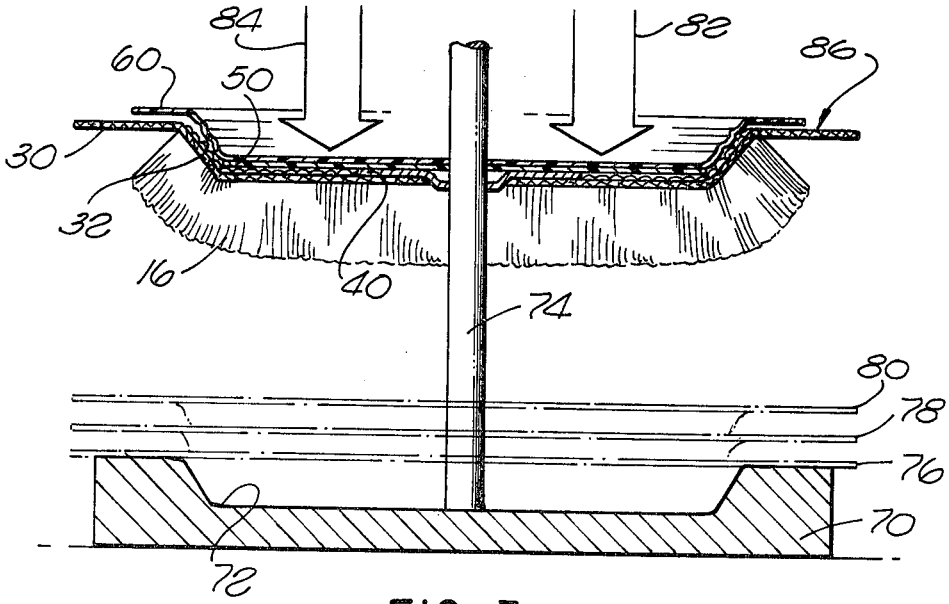
FIG. 3 is a schematic diagram illustrating a step in the production of a polishing buff as illustrated in FIG. 1.

Subsequent to the formation of the assembly, as shown in FIG. 2, the members 30, 40, 50 and 60 are placed upon a base 70 which defines a dish-shaped depression 72 therein. The dish-shaped depression 72 generally takes the form desired for the buff 10. A rod 74 extends upwardly from the base 70 and is used to properly position the members 30, 40, 50 and 60 in place upon the base 70. Such is accomplished by having the centrally disposed apertures receive the rod 74. After a plurality of the assemblies of members 30, 40, 50 and 60 as shown in phantom at 76, 78 and 80 are positioned upon the base 70, pressure is applied as indicated by the arrows 82 and 84 by any means desired such as a press or by placing an appropriate plate and threading a member over the rod 74 or the like to securely press all of the mold forms 60 into the appropriate fabric layers 30 with the adhesive 36 thereon. By so doing, the adhesive layer 36 is caused to conform to the portion 62 of the mold form 60. The pressure is maintained upon the assembly as illustrated in FIG. 3 for a period of time sufficient to allow the adhesive to set.

After the adhesive has set, the pressure is removed from the assembly and each of the units is then removed from the base 70. At this point the mold forms 60 are removed leaving the assembly of the fabric 30, the metal washer 40 and the backing layer 50 adhesively and permanently secured together. The outer edges of the fabric extending beyond the tufting material, for example, as shown at 86 in FIG. 3, is trimmed by an appropriate cutting apparatus to provide the buff as shown in FIG. 1. At the same time the aperture 52 on the backing layer is enlarged to provide ready access to the aperture 42 in the washer 40 by the stud on the power tool.

Figure 4:
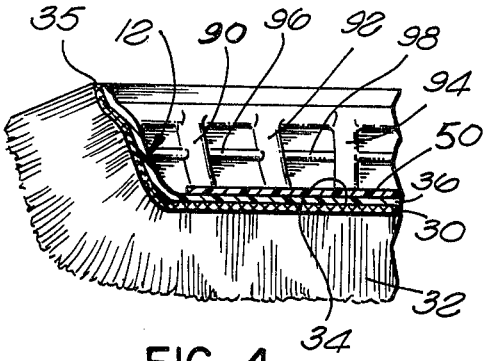
FIG. 4 is a fragmentary view partially in cross section illustrating in more detail features of a polishing buff contructed in accordance with the present invention.

By reference to FIG. 4, a more detailed understanding of the upwardly curved peripheral portion of the buff is illustrated. As is clearly therein shown the layer of fabric 30 includes the tufting material 32 extending outwardly from a first surface 33 thereof. The layer 36 of adhesive is positioned upon the other side 34 of the fabric layer 30. The backing layer 40 is secured in place upon the fabric layer 30 by the adhesive 36. As is also seen, the adhesive 36 extends upwardly and completely out to the edge 35 of the fabric 30 and completely covers the side 34 of the fabric. The adhesive 36 is the sole means for maintaining the curved peripheral portion 12 in the desired configuration. As is shown in FIG. 4, the curved peripheral portion 12 contains the plurality of ridges 90, 92 and 94 formed by the ridges 66 in the mold form 60. Also illustrated is a transverse ridge 96 and 98 interconnecting adjacent ridges 90 and 92 and 92 and 94, respectively. It has been found that the ridges as illustrated at 90–98 provide some additional strength to the curved portion 12 without in any way affecting the flexibility or softness thereof. It has also been discovered that if desired the ridges may be eliminated from the buff without affecting the structural integrity or operation thereof.

As will be noted from the foregoing description and illustration, the washer-like member 40 having the screw thread formed internally thereof provides a ready and secure means for locking the buff upon the stud which is affixed to the spindle of the power-driven apparatus. In turn, the metal washer-like member 40 is permanently and securely affixed to and forms an integral part of the buff 10. By this construction, the power applied from the power-driven member is transmitted directly through the washer-like member 40 to the buff. As a result, all of the power imparted is utilized to drive the buff through the member 40. This construction eliminates swirl marks on the surface which is being buffed which have, in the utilization of prior art devices, been occasioned by relative rotary motion between the support pad and the buff. In prior art structures employing single sided buffing pads, either with or without curved edges, the buffing pad has been held in place upon the support pad by a retaining nut or by a drawstring as is well known. In either of these two instances there is always some relative rotary motion between the buff and the support pad. Through utilization of the permanently affixed washer member 40, such relative rotary motion is eliminated. Obviously, such a structure for the washer member 40 may be used in a buff structure which does not have curved outer edges and the washer may be secured in place by a backing layer which extends over the entire rear surface of the buff.

There has thus been disclosed a method of manufacturing and a resultant buffing pad which securely locks onto a power-driven apparatus and which provides a flexible, soft, peripheral, curved portion which may be utilized in extremely tight radiused areas without fear of damage to the surfaces being finished.

What is claimed is:

1. A polishing buff comprising:

(A) a fabric layer defining a central aperture and having first and second sides;

(B) tufted material stitched into said fabric layer and extending outwardly from said first side thereof only;

(C) a layer of flexible adhesive completely covering said second side of said fabric and the stitches of said tufted material;

(D) the entire peripheral portion of said fabric and the tufted material thereon being permanently curved, said adhesive layer constituting the sole means for maintaining said curved configuration of said peripheral portion;

(E) a metallic washer having a central aperture defining a screw thread;

(F) a backing layer having a central aperture;

(G) said washer being sandwiched between said fabric and said backing layer with said central aperture aligned;

(H) said washer and said backing layer being secured to said fabric layer only by said adhesive; and (I) said backing layer having an outer edge displaced inwardly from the outer edge of said fabric whereby said backing layer does not extend onto said curved peripheral portion.

2. A polishing buff as defined in claim 1 wherein said peripheral curved portion is corrugated.

3. A polishing buff as defined in claim 2 wherein said corrugations extend inwardly from the outer edge of said fabric.

4. A polishing buff as defined in claim 2 wherein said corrugations on said peripheral portion are interconnected by a transverse ridge.

* * * * *

UNITED STATES PATENT AND TRADEMARK OFFICE

CERTIFICATE OF CORRECTION

PATENT NO. : 4,149,294

DATED : April 17, 1979

INVENTOR(S) : Joseph H. MacKay, Jr. and Jack M. Haigh

It is certified that error appears in the above-identified patent and that said Letters Patent are hereby corrected as shown below:

Column 6, line 15, after "fabric" insert -- layer --.

Column 6, line 17, after "fabric" insert -- layer --.

Column 6, lines 25 and 26, after "fabric" insert -- layer --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*